US006470899B2

(12) United States Patent
Johnson et al.

(10) Patent No.: US 6,470,899 B2
(45) **Date of Patent: *Oct. 29, 2002**

(54) COLLAPSIBLE UMBRELLA WITH REINFORCED RIB STRUCTURE

(75) Inventors: Gary D. Johnson, New York City, NY (US); Stanley Hochfeld, deceased, late of Howard Beach, NY (US); Ruth Hochfeld, legal representative, Long Beach, NY (US); Alfonso Murcia, Matawan, NJ (US); Frank Holloway, Freehold, NJ (US)

(73) Assignee: Innoventions Enterprises Ltd., Farmingdale, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/769,888

(22) Filed: Jan. 25, 2001

(65) Prior Publication Data

US 2001/0010231 A1 Aug. 2, 2001

Related U.S. Application Data

(63) Continuation of application No. 09/354,202, filed on Jul. 15, 1999, now Pat. No. 6,206,017, which is a continuation of application No. 08/948,266, filed on Oct. 9, 1997, now Pat. No. 5,975,099.

(60) Provisional application No. 60/028,230, filed on Oct. 10, 1996.

(51) Int. Cl.[7] ..... A45B 25/00

(52) U.S. Cl. ..... 135/29; 135/31; 135/32

(58) Field of Search ..... 135/29, 31, 32, 135/26, 25.31, 25.32, 25.34

(56) References Cited

U.S. PATENT DOCUMENTS

| | | | |
|---|---|---|---|
| 472,457 | A | 4/1892 | Hayes et al. |
| 1,103,799 | A | 7/1914 | McMillan |
| 1,109,736 | A | 9/1914 | Cartwright |

(List continued on next page.)

FOREIGN PATENT DOCUMENTS

| | | |
|---|---|---|
| FR | 724504 | 4/1932 |

*Primary Examiner*—Robert Canfield
(74) *Attorney, Agent, or Firm*—Frishauf, Holtz, Goodman & Chick, P.C.

(57) ABSTRACT

A foldable umbrella includes a post; a stationary hub secured to an upper end of the post; a canopy centrally secured to the stationary hub; a sleeve slidably mounted on the post; a plurality of radially oriented ribs secured to the canopy in equiangularly spaced relation, each rib having a radially inner end and a radially outward end; a plurality of foldable strut assemblies, each strut assembly connected between the sleeve and a respective one of the ribs, each strut assembly including a first strut having one end pivotally connected at a first pivot point to the sleeve and a second end pivotally connected to a respective one of the ribs at a second pivot point spaced radially outwardly from the radially inner end of the rib, a second strut having one end pivotally connected at a third pivot point to the stationary hub and a second end pivotally connected at a fourth pivot point to an intermediate point of the first strut, and a third strut having one end pivotally connected at a fifth pivot point to an intermediate point of the second strut and a second end pivotally connected at a sixth pivot point to the respective one of the ribs, the sixth pivot point being positioned radially inward of the second pivot point; and a U-shaped channel mounted to each rib for receiving the first strut therein when the umbrella is in an open configuration.

32 Claims, 4 Drawing Sheets

U.S. PATENT DOCUMENTS

| | | | | | |
|---|---|---|---|---|---|
| 1,140,801 | A | | 5/1915 | Cohic | |
| 1,396,893 | A | | 11/1921 | Simmons et al. | |
| 2,649,103 | A | | 8/1953 | Militano | |
| 2,889,841 | A | | 6/1959 | Kampf | |
| 3,818,919 | A | | 6/1974 | Schultes et al. | |
| 3,896,833 | A | | 7/1975 | Weber et al. | |
| 4,979,534 | A | | 12/1990 | Johnson et al. | |
| 4,986,294 | A | | 1/1991 | Wu | |
| 5,063,953 | A | | 11/1991 | Wu | |
| 5,065,779 | A | | 11/1991 | Johnson et al. | |
| 5,121,764 | A | * | 6/1992 | Wu | 135/31 |
| 5,161,562 | A | | 11/1992 | Wu | |
| D336,982 | S | | 7/1993 | Johnson et al. | |
| 5,235,998 | A | | 8/1993 | Liu | |
| 5,297,572 | A | | 3/1994 | Kuo | |
| 5,368,055 | A | | 11/1994 | Johnson et al. | |
| 5,435,331 | A | | 7/1995 | Okuda | |
| 5,467,792 | A | | 11/1995 | Okuda | |
| 5,487,401 | A | | 1/1996 | Johnson et al. | |
| 5,551,463 | A | | 9/1996 | Wang | |
| 5,597,004 | A | | 1/1997 | Okuda | |
| 5,842,493 | A | | 12/1998 | Yakubisin | |
| 5,975,099 | A | | 11/1999 | Johnson et al. | |
| 6,202,661 | B1 | * | 3/2001 | Okuda | 135/29 |
| 6,206,017 | B1 | * | 3/2001 | Johnson et al. | 135/29 |

* cited by examiner

COLLAPSIBLE UMBRELLA WITH REINFORCED RIB STRUCTURE

This is a continuation, of application Ser. No. 09/354,202 filed Jul. 15, 1999 now U.S. Pat. No, 6,206,017, which is a continuation of application Ser. No. 08/948,266 filed Oct. 9, 1997, now U.S. Pat. No. 5,975,099, issued on Nov. 2, 1999, which claims the benefit of U.S. Provisional Application Serial No. 60/028,230.

BACKGROUND OF THE INVENTION

The present invention relates generally to umbrellas, and more particularly, is directed to a collapsible umbrella with a reinforced rib structure.

Compact foldable umbrellas are known which include a telescoping center post with a handle secured to the lower end thereof, the handle being adapted to be grasped by a user to carry the umbrella in its stored configuration and to hold the umbrella in its raised, opened configuration. A stationary hub is secured at the upper end of the center post, with a canopy centrally secured to the stationary hub, and a sleeve is slidably mounted on the telescoping post.

A plurality of equiangularly spaced, radially directed ribs are secured to the canopy in equiangularly spaced relation, each rib having a radially inward end and a radially outward end.

A plurality of strut assemblies are provided, each connected between the sleeve and a respective rib. Each strut assembly includes a first strut having one end pivotally connected at a first pivot point to the sleeve and a second end pivotally connected to a rib at a second pivot point spaced slightly radially outward from the radially inward end of the rib. A second strut has one end pivotally connected at a third pivot point to the stationary hub and a second end pivotally connected at a fourth pivot point to an intermediate point of the first strut, and a third strut has one end pivotally connected at a fifth pivot point to an intermediate point of the second strut and a second end pivotally connected at a sixth pivot point to the respective one of the ribs, the sixth pivot point being positioned radially inward of the second pivot point.

However, a problem with such arrangement is that, during high winds, the forces on the canopy may invert the canopy, rendering the umbrella useless. Specifically, the first strut will pivot relative to the rib about the second pivot point such that the first strut moves to a position adjacent the sixth pivot point. In such case, there is nothing to stop the inversion of the umbrella. As a result, the first strut continues pivoting upwardly relative to the sleeve about the first pivot point, resulting in inversion of the umbrella.

Although various umbrellas are known which include channels for receiving strut members, these channels are not arranged relative to the ribs with the channel facing toward the ribs in a direction to prevent inversion of the umbrella. As a result, such channels will not prevent an upward inversion of the ribs, for example when the umbrella is subjected to high wind forces.

SUMMARY OF THE INVENTION

Accordingly, it is an object of the present invention o provide an umbrella that overcomes the aforementioned problems with the prior art.

It is another object of the present invention to provide an umbrella which provides improved structural integrity and strength to the umbrella in the open configuration thereof.

It is still another object of the present invention to provide an umbrella in which inversion of the canopy is inhibited.

It is yet another object of the present invention to provide an umbrella which inhibits lateral movement of the ribs.

In accordance with an aspect of the present invention, a foldable umbrella comprises a post; a stationary hub secured to an upper end of said post; at least one canopy centrally secured to said stationary hub; a sleeve slidably mounted on said post; a plurality of radially oriented ribs secured to said canopy in equiangularly spaced relation, each said rib having a radially inner end and a radially outward end; and a plurality of foldable strut assemblies, each strut assembly connected between said sleeve and a respective one of said ribs. Each strut assembly includes at least a first strut member having one end portion pivotally connected at a first pivot point to said sleeve and a second end portion pivotally connected to a respective one of said ribs at a second pivot point spaced radially outwardly from said radially inner end of the rib, and a U-shaped channel mounted to one of said rib and said first strut member for receiving the other of said rib end first strut member therein when said umbrella is in an open configuration and when said rib is caused to move toward an inverted condition of the umbrella.

In accordance with another aspect of the present invention, a foldable umbrella includes a post; a stationary hub secured to an upper end of the post; a canopy centrally secured to the stationary hub; a sleeve slidably mounted on the post; a plurality of radially oriented ribs secured to the canopy in equiangularly spaced relation, each rib having a radially inner end and a radially outward end; a plurality of strut assemblies, each strut assembly connected between the sleeve and a respective one of the ribs, each strut assembly including a first strut having one end pivotally connected at a first pivot point to the sleeve and a second end pivotally connected to a respective one of the ribs at a second pivot point spaced radially outwardly from the radially inner end of the rib, a second strut having one end pivotally connected at a third pivot point to the stationary hub and a second end pivotally connected at a fourth pivot point to an intermediate point of the first strut, and a third strut having one end pivotally connected at a fifth pivot point to an intermediate point of the second strut and a second end pivotally connected at a sixth pivot point to the respective one of the ribs, the sixth pivot point being positioned radially inward of the second pivot point; and a U-shaped channel mounted to each rib for receiving the first strut therein when the umbrella is in an open configuration.

Specifically, a bracket is secured to the radially inner end of each rib, the first strut is pivotally secured to the bracket at the second pivot point, and thereby to the rib, the third strut is pivotally secured to the bracket at the sixth pivot point, and thereby to the rib, and the U-shaped channel is provided on the bracket at a position between the second and sixth pivot points. The U-shaped channel has an open end that extends down in the open configuration of the umbrella, for receiving the first strut therein, and is dimensioned to snugly receive the first strut therein.

In accordance with still another aspect of the present invention, a foldable umbrella includes a post; a stationary hub secured to an upper end of the post; a canopy centrally secured to stationary hub; a sleeve slidably mounted on the post; a plurality of radially oriented ribs secured to the canopy in equiangularly spaced relation, each rib having a radially inner end and a radially outward end; a plurality of strut assemblies, each strut assembly connected between the sleeve and a respective one of the ribs, each strut assembly including a first strut having one end pivotally connected at a first pivot point to the sleeve and a second end pivotally connected to a respective one of the ribs at a second pivot point spaced radially outwardly from the radially inner end of the rib, a second strut having one end pivotally connected at a third pivot point to the stationary hub and a second end pivotally connected at a fourth pivot point to an intermediate point of the first strut, and a third strut having one end pivotally connected at a fifth pivot point to an intermediate point of the second strut and a second end pivotally connected at a sixth pivot point to the respective one of the ribs, the sixth pivot point being positioned radially inward of the second pivot point; and at least one of the first through third struts having a substantially U-shaped bend therein for receiving another part of the umbrella in a closed configuration of the umbrella so as to enable the umbrella to fold into a more compact configuration.

Preferably, a bracket is secured to the second strut at the intermediate point thereof for pivotally securing the one end of the third strut to the second strut at the fifth pivot point, and wherein the first strut has the substantially U-shaped bend therein adjacent the fourth pivot point, for receiving the bracket in the closed configuration of the umbrella.

The above and other objects, features and advantages of the present invention will become readily apparent from the following detailed description thereof which is to be read in connection with the accompanying drawings.

DETAILED DESCRIPTION

Figure 1:
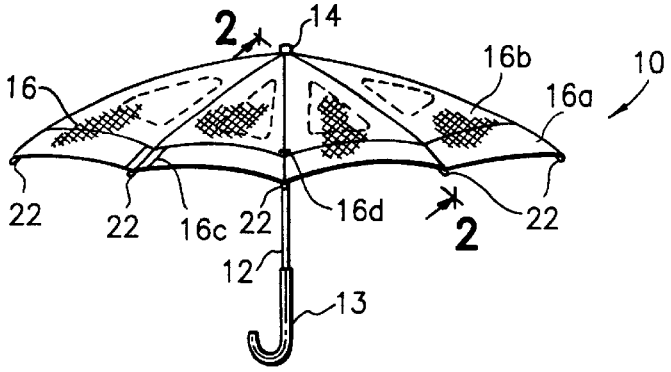
FIG. 1 is an elevational view of an umbrella according to the present invention.

Referring to the drawings in detail, an umbrella 10 according to the present invention includes a telescoping post 12 with a handle 13 secured to the lower end thereof. The manner in which post 12 telescopes is well known in the art, and can be found in any conventional umbrella, such as those sold under the trademark TOTES.

A stationary hub 14 is secured to the upper end of telescoping post 12, and a canopy 16 is centrally secured to stationary hub 14. Canopy 16 can be any conventional canopy, such as that found in umbrellas sold under the trademark TOTES. However, canopy 16 is preferably of the double-canopy vented type disclosed in U.S. Pat. Nos. 4,979,534; 5,065,779; 5,368,055; and 5,487,401; and U.S. Design Pat. No. 336,982, all to Johnson et al, and the entire contents of which are incorporated herein by reference. A double-canopy vented type, including a lower vented canopy 16*a* and an upper canopy 16*b* secured to the lower canopy by elastic 16*c* or by sewing 16*d* (see FIG. 1) is preferred due to its windproof characteristic as described in the Johnson et al patents. The vents may be of the type shown in the Johnson et al patents, or it may be a mesh or any other type of vent, which is covered by an upper canopy. The upper canopy can be connected by elastic members as shown in the drawings of the Johnson et al patents or it may be tacked (sewn) down at spaced apart portions to the lower canopy. Other attachments of the upper canopy can be used, as desired. The invention is described below with generic reference to a canopy, but a double canopy windproof vented umbrella is preferred.

Figure 2:
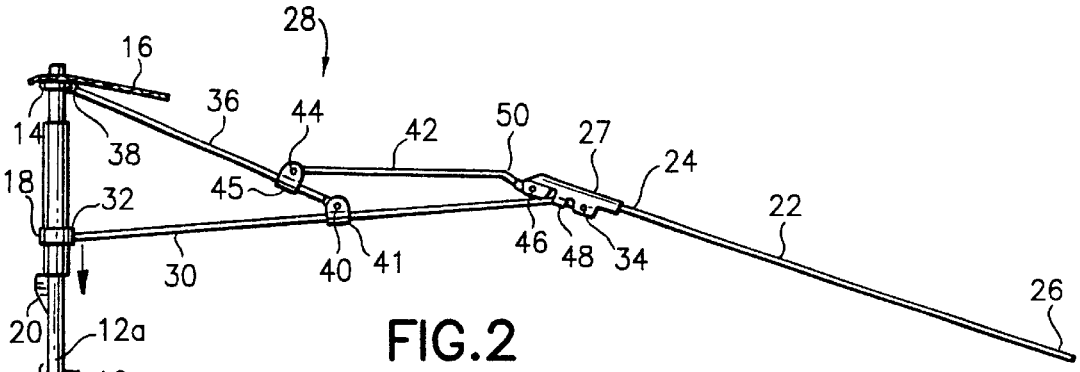
FIG. 2 is a cross-sectional view of a portion of the umbrella of FIG. 1 in the open configuration of the umbrella, taken along line 2—2 thereof.

As shown in FIG. 2, a sleeve 18 is slidably mounted on telescoping post 12, and can be releasably locked in position in the open configuration of umbrella 10 by a spring-loaded latch 20, as is conventional. Post 12 has two telescoping post members 12*a*, 12*b*, as is conventional, and a handle 13.

A plurality of radially oriented ribs 22 are secured to canopy 16 in equiangularly spaced relation, each rib 22 having a radially inner end 24 and a radially outward end 26. Radially outward ends 26 are secured to the outer periphery of canopy 16 in a conventional manner by means of a tip member, or as shown in the Johnson et al patents identified above, while radially inner end portions 24 are secured to intermediate points of canopy 16. Ribs 22 function to hold canopy 16 in a desired position. A bracket 27 is secured to the radially inner end 24 of each rib 22.

A plurality of strut assemblies 28 are connected between stationary hub 14, sleeve 18 and ribs 22. Specifically, in the embodiment shown, each strut assembly 28 includes a first strut 30 having one end pivotally connected at a first pivot point 32 to sleeve 18 and a second end pivotally connected to a respective rib 22 at a second pivot point 34 or bracket 27. The second pivot point 34 is spaced radially outwardly by a small distance from the radially inner end portion 24 of the respective rib 22. Specifically, second pivot point 34 is formed at a radially outer end of bracket 27.

Each strut assembly 28 further includes a second strut 36 having one end pivotally connected at a third pivot point 38 to stationary hub 14 and a second end pivotally connected at a fourth pivot point 40 located at an intermediate portion of first strut 30. In this regard, a bracket 41 is secured to the intermediate portion of first strut 30 to provide such fourth pivot point 40.

Each strut assembly 28 also includes a third strut 42 having one end pivotally connected at a fifth pivot point 44 to an intermediate portion of second strut 36 and a second end pivotally connected at a sixth pivot point 46 to the respective rib 22. The sixth pivot point 46 is positioned radially inward of the second pivot point 34. Specifically, sixth pivot point 34 is formed at a radially inner end of bracket 27. A bracket 45 is secured to the intermediate portion of second strut 36 to provide such fourth pivot point 40.

Each strut assembly 28 thereby forms a four bar linkage in a generally parallelogram configuration, which is defined by pivot points 34, 40, 44 and 46.

The above described arrangement is conventional. However, a problem with such arrangement is that, during high winds, the forces on canopy 16 may tend to invert canopy 16, that is, forcing ribs 22 upward from the position shown in FIG. 2, bending the ribs and rendering the umbrella useless. Specifically, during such inversion, ribs 22 will pivot upwardly relative to first struts 30,about pivot points 34. In a conventional arrangement, due to lateral displacement of ribs 22 relative to respective ribs 30, the respective pivot point 46 will move to a position alongside and even lower than first strut 30, since, in a conventional construction, there is nothing to prevent such movement.

Figure 5:
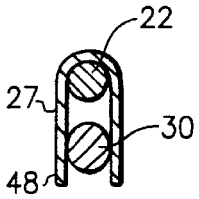
FIG. 5 is a cross-sectional view of the strut assembly of FIG. 3A, taken along line 5—5 in FIG. 3A.

In accordance with one embodiment of the present invention, bracket 27 includes a U-shaped channel portion 48 mounted thereto, and thereby to each rib 22, at a position between second and sixth pivot points 34 and 46. As a result, in the open configuration of umbrella 10, the radially outer end of first strut 30 is engaged within U-shaped channel 48. See FIG. 5. This prevents lateral movement of ribs 22 relative to first struts 30. Further, in the event that an inversion force is applied to ribs 22, U-shaped channel 48 will prevent such inversion. Specifically, any such inversion force will tend to rotate rib 22 in the counter-clockwise direction of FIG. 2 about pivot point 34. This pivotal movement, however, is opposed by the engagement of first strut 30 within U-shaped channel 48. Accordingly, such inversion of ribs 22 does not occur.

Figure 4:
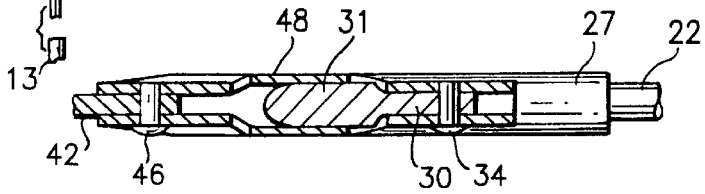
FIG. 4 is a cross-sectional view of the strut assembly of FIG. 3A, taken along line 4—4 in FIG. 3A.

To provide enhanced engagement, the radially outer end of each strut 30 has an enlarged, thicker end 31, as shown in FIG. 4. U-shaped channel 48 is dimensioned to snugly receive enlarged end 31 therein.

Further, in order to ensure that struts 30 are engaged by U-shaped channels 48 during the open configuration of umbrella 10, the radially outer ends of first and third struts 42 are bent downwardly, as at 49 and 50 (FIG. 3B), respectively. Bend 50 results in U-shaped channel 48 being angled downwardly to receive first strut 30 therein, while bend 49 provides that strut 30 is received in U-shaped channel 48. Conventional folding umbrella structures do not have the bends 49 and 50. Bend 50 could be omitted in some cases, if the bend 49 is large enough and/or if U-shaped. channel 48 is long (deep) enough to engage first strut 30 when the umbrella is in its open condition.

The bends 49, 50 enable a contact to be maintained between the outermost end portion of first strut 30 and the end portion of bracket 27, thus improving structural integrity and stability of the rib structures. The various pivots are preferably made using rivets, as shown by 34 and 36 in FIG. 4. Other pivot devices could be used, as is conventional.

The outermost end of first strut 30 could normally be outside of U-shaped channel 48 if it is close enough thereto such that when an inversion force (such as wind) is applied, the first strut 30 will be received in U-shaped channel 48 to prevent inversion.

Figure 6A:
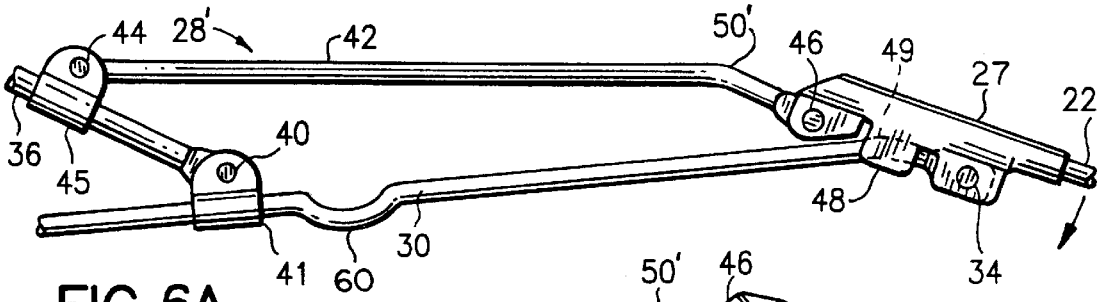
FIG. 6A is an enlarged elevational view of the strut assembly of a modified umbrella according to the present invention, in the fully open configuration of the umbrella.
Figure 6B:
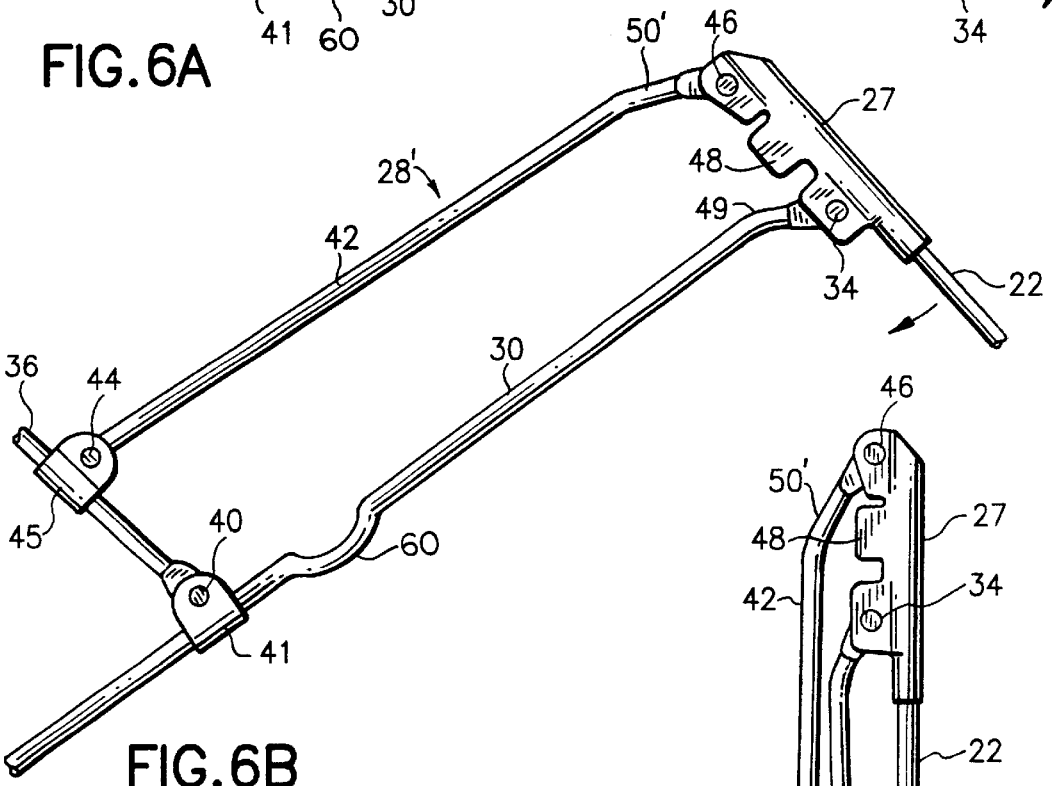
FIG. 6B is an enlarged elevational view of the strut assembly of FIG. 6A in a partially open configuration of the umbrella.
Figure 6C:
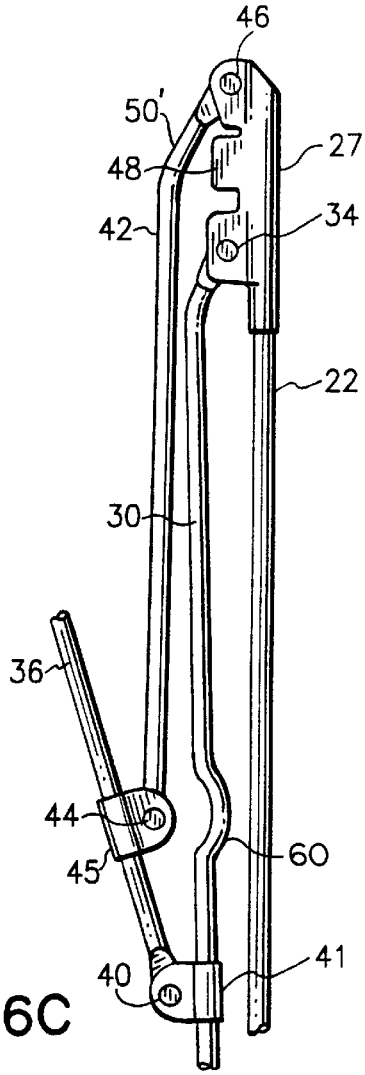
FIG. 6C is an enlarged elevational view of the strut assembly of FIG. 6A in a substantially closed or folded configuration of the umbrella.

Referring now to FIGS. 6A–6C, a modified strut assembly 28' according to another embodiment of the present invention will now be described in which elements which are the same as those described in regard to the first embodiment of FIGS. 1–5 are identified by the same reference numerals, so that a detailed description of such common elements is omitted herein for the sake of brevity.

Strut assembly 28' of FIGS. 6A–6C is identical to strut assembly 28 except that the bend 50' is made greater and a small section of first strut 30 is formed with a small bend 60 that is positioned adjacent to bracket 41 and pivot point 40. With this arrangement, umbrella 10 can be closed into a tighter closed configuration by reason of bracket 45 being received Within bend 60 as shown in FIG. 6C (partially closed position).

Figure 3A:
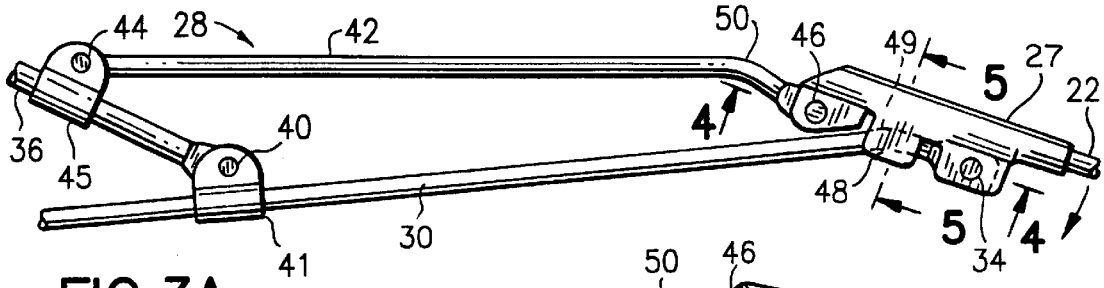
FIG. 3A is an enlarged elevational view of the strut assembly of the umbrella of FIG. 1 in the fully open configuration of the umbrella.
Figure 3B:
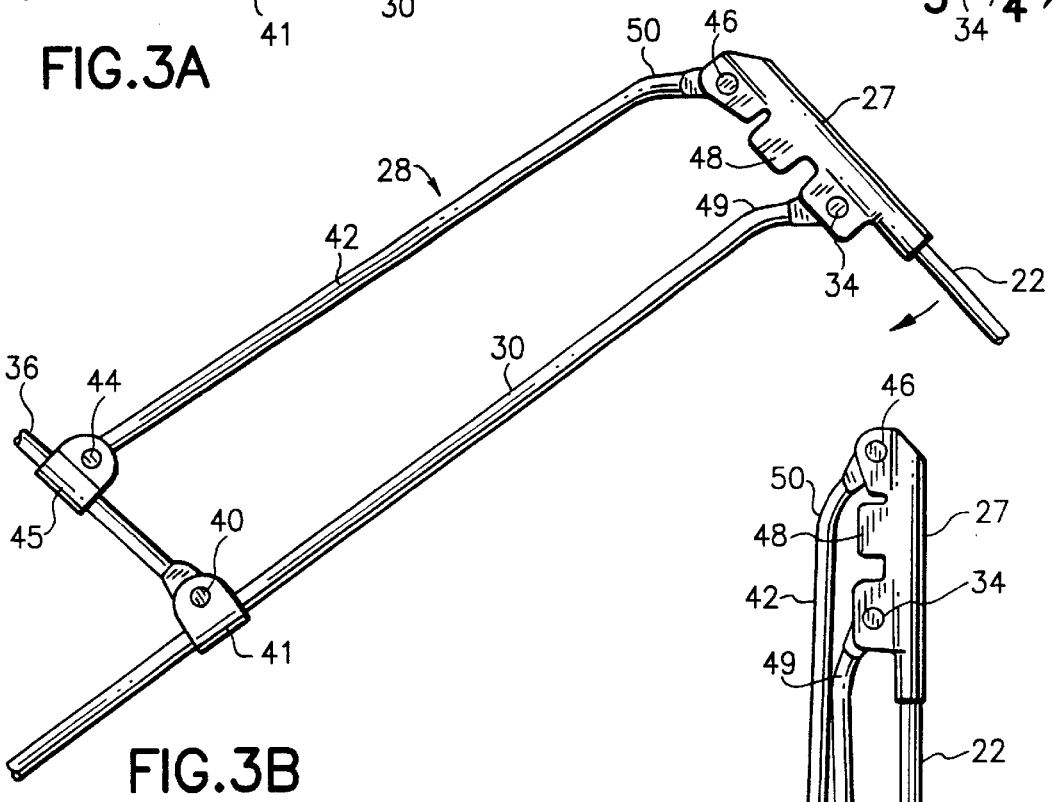
FIG. 3B is an enlarged elevational view of the strut assembly of FIG. 3A in a partially open configuration of the umbrella.
Figure 3C:
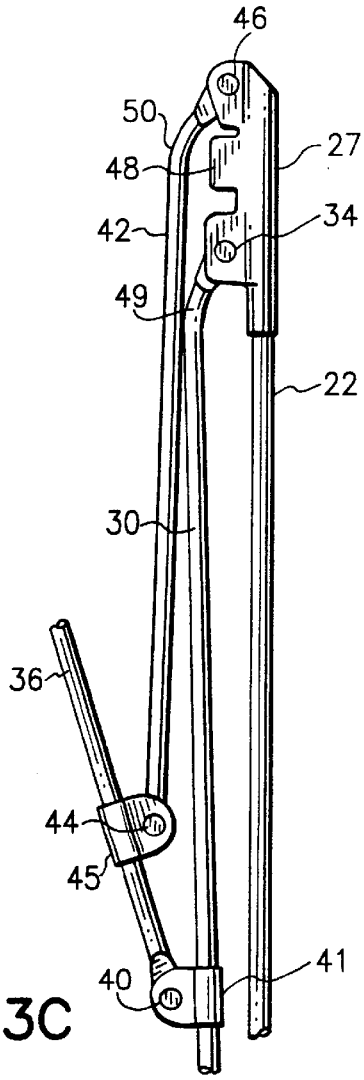
FIG. 3C is an enlarged elevational view of the strut assembly of FIG. 3A in a substantially closed or folded configuration of the umbrella.

In FIG. 3C, the bends 49, 50 could be varied in length of bent portion, angle, location of bend, etc. (if the U-shaped channel is arranged to engage strut 30) to enable the structure to fold flatter. In FIG. 3C, the bend 50 is shown larger than the bend 50 in the other Figures to achieve such a result.

Figure 7:
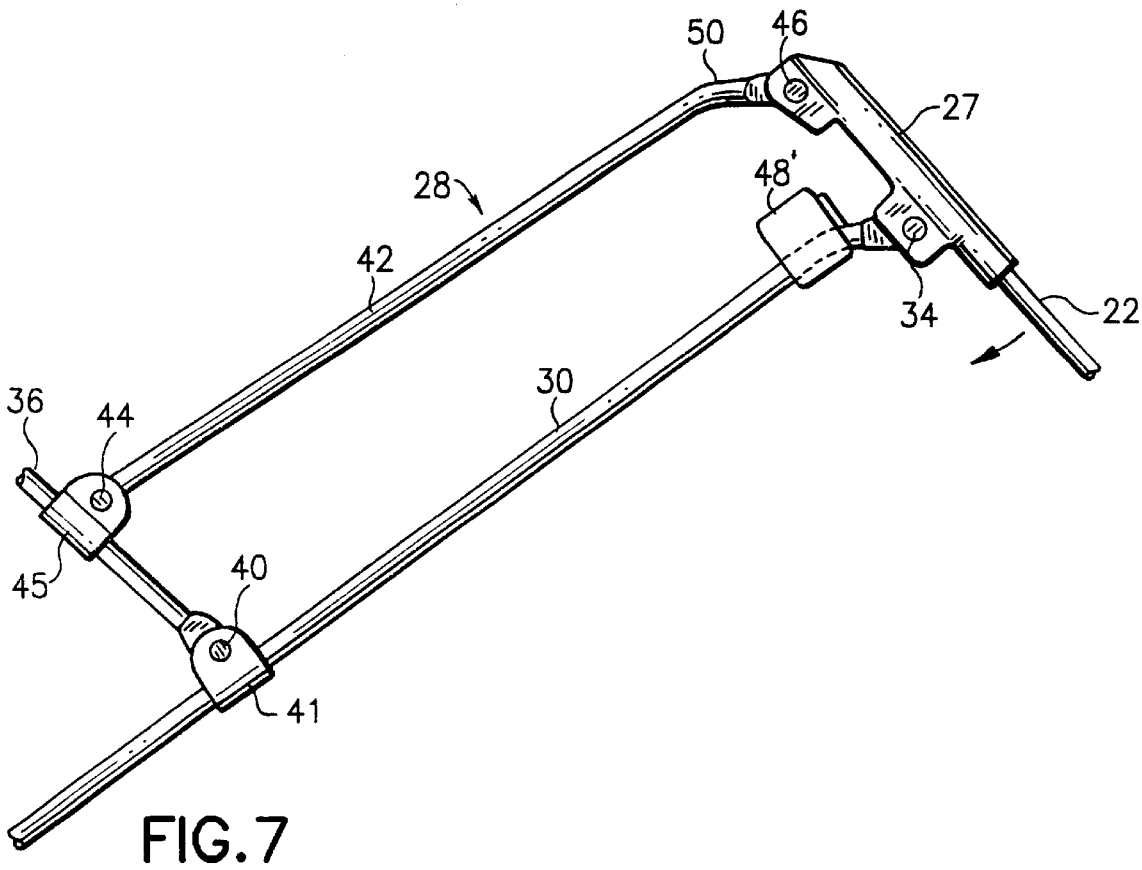
FIG. 7 is a view similar to that of FIG. 3B, but showing a modified embodiment of the present invention.

FIG. 7 shows a modified embodiment of the present invention, similar to the embodiment of FIG. 3B, but wherein the U-shaped channel member 48' is mounted on the strut 30 and is arranged to engage the bracket 27 portion of the rib 22 when the umbrella is in its fully open condition and/or when the rib 22 is forced upwardly to a direction to tend to invert the canopy. This structure provides similar effects as the U-shaped channel member 48 described in connection with the other embodiments of the invention. The U-shaped channel member of FIG. 7 must be made sufficiently short so that it does not project past the rib 22 or bracket 27 in the upward direction when the umbrella is forced toward an inverted position, so as not to pierce the fabric of the canopy.

While the rib and strut structure is shown as being made of metal, other lighter weight materials such as fiberglass impregnated in synthetic resin, or other plastic materials having sufficient strength, could be used.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A foldable umbrella comprising:

a post;

at least one canopy coupled to an upper end portion of said post;

a sleeve slidably mounted on said post;

a plurality of radially oriented ribs secured to said at least one canopy, each said rib having a radially inner end and a radially outward end; and a plurality of foldable strut assemblies, each strut assembly connected between said sleeve and a respective one of said ribs, each strut assembly including:

at least a first strut member having one end portion pivotally connected at a first pivot to said sleeve and a second end portion pivotally connected to a respective one of said ribs at a second pivot spaced radially outwardly from said radially inner end of the rib, and an engaging member on one of said rib and said first strut member, for restraining lateral or sideways movement of said rib relative to said first strut member at least when said rib is caused to move toward an inverted condition of the umbrella, said engaging member being at a position near said second pivot and spaced from said second pivot, and arranged between said second pivot and said post, and said engaging member having spaced apart legs extending from said one of said rib and said first strut member so as to engage at least a portion of the other of said rib and first strut member at a position near said second pivot and spaced apart from said second pivot and arranged between said second pivot and said post, to thereby restrain said lateral or sideways movement of said rib relative to said first strut member at least when said rib is caused to move toward an inverted condition of the umbrella, and wherein said engaging member is dimensioned to receive a portion of said other of said rib and first strut member between the legs thereof at least at a position spaced from said second pivot and at least when said rib is caused to move toward an inverted condition of the umbrella.

2. An umbrella according to claim 1, wherein said engaging member is mounted to said rib and has an open end that extends down in the open configuration of the umbrella, for engaging said first strut member.

3. An umbrella according to claim 1, wherein said engaging member is arranged to receive said portion of said other of said rib and first strut member also when said umbrella is in a normally open configuration.

4. An umbrella according to claim 3, wherein said engaging member is dimensioned to snugly receive said portion of said other of said rib and first strut member.

5. An umbrella according to claim 1, wherein said engaging member is dimensioned to snugly receive said portion of said other of said rib and first strut member.

6. An umbrella according to claim 1, wherein said post is a telescoping post including at least two telescoping post members.

7. An umbrella according to claim 1, wherein said engaging member is mounted to said first strut member and has an open end that extends upwardly in the open configuration of the umbrella.

8. An umbrella according to claim 7, wherein said engaging member is dimensioned to receive a respective one of said ribs.

9. An umbrella according to claim 1, wherein said engaging member is spaced apart from said second pivot with a non-engaging area between said engaging member and said second pivot, said non-engaging area being an area at which said other of said rib and first strut member is not engaged or contacted.

10. An umbrella according to claim 1, wherein said portion of said other of said rib and first strut member is received between said legs of said engaging member when said rib is caused to move to an inverted condition of the umbrella.

11. An umbrella according to claim 1, wherein a stationary hub is secured to an upper end portion of said post, and said at least one canopy is coupled to said post via said stationary hub.

12. An umbrella according to claim 1, wherein a non-engaging area is provided between said engaging member and said second pivot, said non-engaging area being an area at which said other of said rib and said first strut member is not engaged or contacted.

13. An umbrella according to claim 1, wherein when said rib is caused to move toward an inverted condition of the umbrella, the other of said rib and first strut member is completely engaged between the legs of the engaging member.

14. A foldable umbrella comprising:

a post;

at least one canopy coupled to an upper end portion of said post;

a sleeve slidably mounted on said post;

a plurality of radially oriented ribs secured to said canopy, each said rib having a radially inner end and a radially outward end;

a plurality of foldable strut assemblies, each strut assembly connected between said sleeve and a respective one of said ribs, each strut assembly including:

a first strut having one end pivotally connected at a first pivot to said sleeve and a second end pivotally connected to a respective one of said ribs at a second pivot spaced radially outwardly from said radially inner end of the rib, a second strut having one end pivotally connected at a third pivot to said upper end portion of said post and a second end pivotally connected at a fourth pivot to an intermediate point of said first strut, and a third strut having one end pivotally connected at a fifth pivot to an intermediate point of said second strut and a second end pivotally connected at a sixth pivot to said respective one of said ribs, said sixth pivot being positioned radially inward of said second pivot; and an engaging member mounted to each said rib, for restraining lateral or sideways movement of said rib relative to said first strut at least when said rib is caused to move toward an inverted condition of the umbrella, said engaging member being at a position near said second pivot and spaced from said second pivot, and arranged between said second pivot and said post, and said engaging member having spaced apart legs extending from said rib toward said first strut so as to engage at least a portion of said first strut at a position near said second pivot and between said second pivot and said post, to thereby restrain said lateral or sideways movement of said rib relative to said first strut at least when said rib is caused to move toward an inverted condition of the umbrella, and wherein said engaging member is dimensioned to receive a portion of said first strut between the legs thereof at least at a position spaced from said second pivot and at least when said rib is caused to move toward an inverted condition of the umbrella.

15. An umbrella according to claim 14, wherein a non-engaging area is provided between said engaging member and said second pivot, said non-engaging area being an area at which said other of said rib and said first strut member is not engaged or contacted.

16. An umbrella according to claim 14, wherein when said rib is caused to move toward an inverted condition of the umbrella, the first strut is completely engaged between the legs of the engaging member between the second pivot and the sixth pivot.

17. A foldable umbrella comprising:

a post;

at least one canopy coupled to an upper end portion of said post;

a sleeve slidably mounted on said post;

a plurality of radially oriented ribs secured to said at least one canopy, each said rib having a radially inner end and a radially outward end; and a plurality of foldable strut assemblies, each strut assembly connected between said sleeve and a respective one of said ribs, each strut assembly including:

at least a first strut member having one end portion pivotally connected at a first pivot to said sleeve and a second end portion pivotally connected to a respective one of said ribs at a second pivot spaced radially outwardly from said radially inner end of the rib, and engaging means on one of said rib and said first strut member, for restraining lateral or sideways movement of said rib relative to said first strut member at least when said rib is caused to move toward an inverted condition of the umbrella, said engaging means being at a position near said second pivot and spaced from said second pivot, and arranged between said second pivot and said post, and said engaging means having spaced apart legs extending from said one of said rib and said first strut member so as to engage at least a portion of the other of said rib and first strut member at a position near said second pivot and spaced apart from said second pivot and between said second pivot and said post, to thereby restrain said lateral or sideways movement of said rib relative to said first strut member at least when said rib is caused to move toward an inverted condition of the umbrella, and wherein said engaging means is dimensioned to receive a portion of said other of said rib and first strut member between the legs thereof at least at a position spaced from said second pivot and at least when said rib is caused to move toward an inverted condition of the umbrella.

18. An umbrella according to claim 17, wherein said engaging means is mounted to said rib and has an open end that extends down in the open configuration of the umbrella, for engaging said first strut member.

19. An umbrella according to claim 17, wherein said engaging means is arranged to receive said portion of said other of said rib and first strut member also when said umbrella is in a normally open configuration.

20. An umbrella according to claim 19, wherein said engaging means is dimensioned to snugly receive said portion of said other of said rib and first strut member.

21. An umbrella according to claim 17, wherein said engaging means is dimensioned to snugly receive said portion of said other of said rib and first strut member.

22. An umbrella according to claim 17, wherein said post is a telescoping post including at least two telescoping post members.

23. An umbrella according to claim 17, wherein said engaging means is mounted to said first strut member and has an open end that extends upwardly in the open configuration of the umbrella.

24. An umbrella according to claim 23, wherein said engaging means is dimensioned to receive a respective one of said ribs.

25. An umbrella according to claim 17, wherein said engaging means is spaced apart from said second pivot with a non-engaging area between said engaging means and said second pivot, said non-engaging area being an area at which said other of said rib and first strut member is not engaged or contacted.

26. An umbrella according to claim 17, wherein said portion of said other of said rib and first strut member is received between said legs of said engaging means when said rib is caused to move to an inverted condition of the umbrella.

27. An umbrella according to claim 17, wherein a stationary hub is secured to an upper end portion of said post, and said at least one canopy is coupled to said post via said stationary hub.

28. An umbrella according to claim 17, wherein a non-engaging area is provided between said engaging means and said second pivot, said non-engaging area being an area at which said other of said rib and said first strut member is not engaged or contacted.

29. An umbrella according to claim 17, wherein when said rib is caused to move toward an inverted condition of the umbrella, the other of said rib and first strut member is completely engaged between the legs of the engaging member.

30. A foldable umbrella comprising:

a post, at least one canopy coupled to an upper end portion of said post;

a sleeve slidably mounted on said post;

a plurality of radially oriented ribs secured to said canopy, each said rib having a radially inner end and a radially outward end;

a plurality of foldable strut assemblies, each strut assembly connected between said sleeve and a respective one of said ribs, each strut assembly including:

a first strut having one end pivotally connected at a first pivot to said sleeve and a second end pivotally connected to a respective one of said ribs at a second pivot spaced radially outwardly from said radially inner end of the rib, a second strut having one end pivotally connected at a third pivot to said upper end portion of said post and a second end pivotally connected at a fourth pivot to an intermediate point of said first strut, and a third strut having one end pivotally connected at a fifth pivot to an intermediate point of said second strut and a second end pivotally connected at a sixth pivot to said respective one of said ribs, said sixth pivot being positioned radially inward of said second pivot; and engaging means mounted to each said rib, for restraining lateral or sideways movement of said rib relative to said first strut at least when said rib is caused to move toward an inverted condition of the umbrella, said engaging means being at a position near said second pivot and spaced from said second pivot, and arranged between said second pivot and said post, and said engaging means having spaced apart legs extending from said rib toward said first strut so as to engage at least a portion of said first strut at a position near said second pivot and spaced from said second pivot, and between said second pivot and said post, to thereby restrain said lateral or sideways movement of said rib relative to said first strut at least when said rib is caused to move toward an inverted condition of the umbrella, and wherein said engaging means is dimensioned to receive a portion of said first strut between the legs thereof at least at a position spaced from said second pivot and at least when said rib is caused to move toward an inverted condition of the umbrella.

31. An umbrella according to claim 30, wherein a non-engaging area is provided between said engaging means and said second pivot, said non-engaging area being an area at which said other of said rib and said first strut member is not engaged or contacted.

32. An umbrella according to claim 30, wherein when said rib is caused to move toward an inverted condition of the umbrella, the first strut is completely engaged between the legs of the engaging member between the second pivot and the sixth pivot.

* * * * *